US010641550B2

(12) United States Patent
Reed

(10) Patent No.: US 10,641,550 B2
(45) Date of Patent: May 5, 2020

(54) DEVICE FOR TRANSPORTING AND DRYING WET ITEMS

(71) Applicant: Dylan John Reed, San Diego, CA (US)

(72) Inventor: Dylan John Reed, San Diego, CA (US)

( * ) Notice: Subject to any disclaimer, the term of this patent is extended or adjusted under 35 U.S.C. 154(b) by 120 days.

(21) Appl. No.: 15/911,043

(22) Filed: Mar. 2, 2018

(65) Prior Publication Data

US 2018/0252471 A1 Sep. 6, 2018

Related U.S. Application Data

(60) Provisional application No. 62/466,848, filed on Mar. 3, 2017.

(51) Int. Cl.
*F26B 5/00* (2006.01)
*F26B 19/00* (2006.01)

(52) U.S. Cl.
CPC ..... *F26B 5/00* (2013.01); *F26B 19/005* (2013.01)

(58) Field of Classification Search
CPC ..... F26B 5/00; F26B 19/005; D06F 95/00; D06F 95/002; D06F 95/004; D06F 95/006
See application file for complete search history.

(56) References Cited

U.S. PATENT DOCUMENTS 2,975,529 A 3/1961 Weber
3,264,755 A 8/1966 Moore
3,432,939 A 3/1969 Eichholz
3,905,125 A 9/1975 Hubner
4,245,666 A * 1/1981 Norris ..... E04D 13/00 137/357
4,572,364 A 2/1986 Jordan
4,949,842 A 8/1990 Mokiao, II
4,997,000 A * 3/1991 Feast ..... D06F 18/00 134/102.3
5,323,897 A 6/1994 Sperber
5,447,216 A 9/1995 Freyvogel
5,996,249 A 12/1999 Manning
2012/0291823 A1 11/2012 Trent

* cited by examiner

*Primary Examiner* — Jessica Yuen
(74) *Attorney, Agent, or Firm* — TJSL Patent Clinic

(57) ABSTRACT

A drying apparatus promotes drying of a wet item while protecting a surrounding environment from moisture escaping the wet item as it dries. The apparatus includes a waterproof casing comprising one or more waterproof materials and constructed (a) to receive a wet item and (b) prevent the moisture in the wet item from contacting items in the surrounding environment. The waterproof casing also includes a drain structure at one end having an opening through which moisture from the wet item escapes the drying apparatus and one or more rigid structures extending from within the waterproof casing through the opening to create a pathway for the escaping moisture. The drying apparatus also has an intake vent positioned to draw air into the drying apparatus and direct the air over the wet item within the apparatus and through the opening in the drain structure.

8 Claims, 3 Drawing Sheets

DEVICE FOR TRANSPORTING AND DRYING WET ITEMS

CROSS-REFERENCE TO RELATED APPLICATION

This application claims priority from U.S. Provisional Application 62/466,848, filed on Mar. 3, 2017, entitled "DEVICE FOR TRANSPORTING AND DRYING WET ITEMS."

FIELD OF ART

This invention relates to transporting and drying wet items, such as sporting equipment and clothing.

BACKGROUND

Water sports enthusiasts always have wet equipment to deal with upon finishing their chosen activities. This wet equipment becomes problematic to handle and transfer in its wet state. It would be preferable following such an activity for the participant to have immediate access to adequate, safe, protected space to rinse and hang-dry the wet equipment, but this is rarely available due to the outdoor locations at which these activities take place.

In today's fast-paced society, people often transit directly from one activity, event, workplace, or social gathering to another. For example, in Southern California's surfing culture, it is commonplace for a surfer to go directly from the surf to work or to other activities. This allows no time to properly care for their wet equipment. Commonly, wet equipment is stored or transported in waterproof bags or tubs to prevent them from saturating items around them, such as the interiors of the vehicles in which they are transported. This storage method allows no drying to occur. When left in these storage containers repeatedly and over long periods of time, the sports equipment tends to develop mildew and rot. It would be optimal to dry wet articles sufficiently to protect, maintain, and ready them for their next use. Despite some prior attempts in the industry to create solutions for this problem, storage in plastic bins or water proof bags remains a very common practice.

Water sports continue to experience massive growth, including but not limited to, fishing, sailing, boating, jet skiing, canoeing, kayaking, surfing, windsurfing, kite surfing, diving, spearfishing, paddle boarding, stand-up paddle boarding, or just enjoying the beach or a pool. The technology and equipment used in these activities has also grown and evolved, becoming increasingly sophisticated and expensive over time. The popularity of these activities produce a myriad of wet equipment, which becomes problematic to transport and store properly after use.

In addition, there are a wide array of other physical activities that lead to wet or damp equipment, including but not limited to hot yoga, Pilates, cardio fitness, hiking, hunting, mixed martial arts, running, training, or any other sweat-inducing activity, or even just being outdoors on a rainy day. All of this wet equipment must be dried and stored to be properly maintained.

The modern wetsuit, in particular, consists of specialized and expensive neoprene, designed to stretch and conform perfectly to the human body and is used commonly throughout many of these water sports. Wetsuits have been made considerably more comfortable and effective in recent years but require more specialized attention and care with these new materials. It is commonly known among wetsuit users never to hang a wetsuit by the shoulders to dry, as the additional weight added by water will quickly stretch out the material and deteriorate the wetsuit in that crucial shoulder area. The proper way to hang a wet suit is by the waistline over a hanger of sufficient thickness (or diameter) to ensure that no creases are made in the delicate material. If the wetsuit is stowed improperly, the resulting creases cause the material to deteriorate, thus decreasing the wetsuit's ability to retain heat at its full potential.

SUMMARY

Described here is a drying apparatus for use in promoting drying of a wet item while protecting a surrounding environment from moisture escaping the wet item as it dries. The apparatus includes a waterproof casing comprising one or more waterproof materials and constructed (a) to receive a wet item and (b) prevent the moisture in the wet item from contacting items in the surrounding environment. The waterproof casing also includes a drain structure at one end having an opening through which moisture from the wet item escapes the drying apparatus and one or more rigid structures extending from within the waterproof casing through the opening to create a pathway for the escaping moisture. The drying apparatus also has an intake vent positioned to draw air into the drying apparatus and direct the air over the wet item within the apparatus and through the opening in the drain structure.

In some embodiments, a ventilated access panel comprises the intake vent and is coupled to the waterproof casing in a manner to allow placement of the wet item inside the waterproof casing. A zipper device is often used to couple the ventilated access panel to the waterproof casing. In certain embodiments, the drain includes multiple rigid structures, such as rigid tubing, extending from within the waterproof casing.

In some embodiments, an internal hanger couples to the waterproof casing to support the wet item as it dries within the drying apparatus. In some of these embodiments, an external hanger couples to the internal hanger to allow (a) hanging of the drying apparatus from an external structure and (b) transfer of weight from the internal hanger to the external structure. Additionally, the drying apparatus is also able to receive multiple hangers coupled to the waterproof casing to support multiple wet items. In certain embodiments, one or more attachment mechanisms allow temporary closure of the drain structure to prevent water from escaping the drying apparatus. In other embodiments a conduit coupled to the waterproof casing directs air from an external air source directly into the drying device.

DETAILED DESCRIPTION

Figure 1:
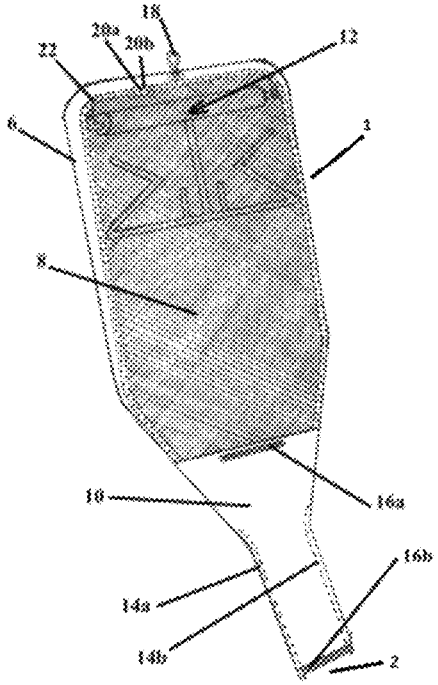
FIG. 1 shows a device for transporting drying wet items, such as wet sports equipment like a wetsuit.

FIGS. 1-5 collectively show a drying device 1 for transporting and drying wet items, such as a garment bag for drying a wetsuit and related water-sports equipment. The drying device 1 is typically constructed as a waterproof casing (e.g., a garment bag) having an outlet 2, or drain, at one end that allows moisture to escape the wet item and exit the drying device 1. In many embodiments the casing tapers to a funnel shape at its drain end to reduce the width of the drying device 1 at the outlet 2 through which moisture escapes the device 1. For embodiments in which the drying device 1 functions as a garment bag, the waterproof casing of the drying device 1 includes a waterproof back panel 6 and a waterproof funnel 10 that are created from one or more waterproof materials, such as vinyl-coated fabric, a waterproof fabric-membrane material (such as those sold under the Gore-Tex® brand), or similar materials. An air-intake vent, typically in the form of a ventilated front panel 8 made of a mesh-like material (such as Texteline®), nylon mesh, or similar screen-type material, allows ventilation of air into and through the drying device 1 to pull moisture from the wet item and into the waterproof funnel 10 at the device's 1 bottom end. The waterproof funnel 10 is designed to direct water from inside the drying device 1 through a closed door (such as the door of an automobile) and out onto the pavement or earth outside. The waterproof funnel 10 is usually made from the same material as the waterproof back panel 6. Together the waterproof back panel 6, the ventilated front panel 8, and the waterproof funnel 10 encapsulate the wet item almost entirely to prevent moisture from contacting the environment surrounding the drying device 1 and to allow enough airflow into and through the device 1 to pull moisture out of the wet item and discharge it through the outlet 2. The ventilated front panel 8 is typically positioned in the upper half of the drying device 1 since gravity acts to pull moisture downward and, for embodiments designed for use within an automobile, is particularly positioned to capture airflow from an open window as the drying device hangs from the clothes hook or handle that sits above a passenger door in the typical car.

For most effective operation, the inside of the waterproof funnel 10 is equipped with rigid or semi-rigid structural elements 14*a*, 14*b*, such as vinyl, plastic, or rubber rods or tubing, designed to substantially hold their shape while penetrating a closed door, thereby creating a pathway through which both water and air are able to escape the drying device through the door and the outlet 2 hanging outside the door. The typical automobile door has a soft, flexible weather-stripping that helps seal the interior of the automobile form the elements outside, and, when designed for use in a car, the right structural elements 14*a*, 14*b* should be sufficiently rigid to penetrate the weather-stripping and prevent being pinched off when the door is closed. The rigid or semi-rigid structural elements 14*a*, 14*b* are mounted within the drying device by any suitable physical or mechanical attachment mechanism or substance, such as a strong adhesive glue, stitching, and heat welding.

The waterproof funnel 10 has sealed seams to prevent water from escaping the device anywhere other than through the end that penetrates the closed door. Sealed seams are preferred throughout the rest of the device as well to prevent water from escaping into the vehicle's interior. Placement of a removable-attachment material 16*a*, 16*b* (such as Velcro® brand hook-and-loop fastener tape) at either end of the waterproof funnel 10 allows closing of the funnel when needed to catch and contain water within the device, such as when the device is being transported by hand with a wet garment inside.

In some embodiments, an attachment loop 18 (e.g., a loop of reinforced fabric) or other device-hanging mechanism allows hanging the drying device from any suitable hanging location or with any suitable hanging structure, such as from a clothes hanger inside a vehicle or over a human finger when being hand-carried. In other embodiments, the drying device is designed to allow use of a traditional clothes hanger (or the like) both for securing the wet item inside the device and for hanging the device itself. In these embodiments, the hook portion of the clothes hanger might extend through a hole in a top surface of the drying device while the body of the clothes hanger resides within the drying device.

In other embodiments, the drying device has its own integrated hanger system 12 for supporting the wet item as it dries within the drying device, often working in conjunction with the attachment loop 18 described above. Additional embodiments may include removable-attachment material (such as snaps, buttons, straps, or hook-and-loop fastener tape) interconnected to the top corners of the hanger system 34*b*. The attachment loop 18 extends from the waterproof back panel 6 to transfer direct weight load from the hanger system 12 to the external support structure from which the drying device hangs. The hanger system 12 is typically made of a rigid material such as plastic, wood, or composites, and, in certain embodiments, has a cross-member of a much greater thickness (i.e., larger diameter) than a standard household clothes hanger. Two zipper sliders 20*a*, 20*b* transit along a zipper chain 22 to allow opening and closing the device and access inside it. The zipper chain 22 runs the perimeter of the device and is operable from either side.

Figure 2:
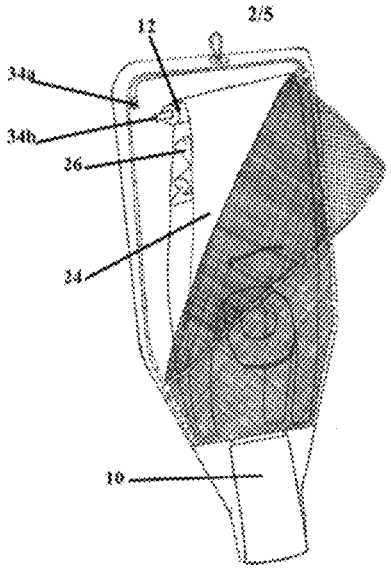
FIG. 2 shows the device in use with sports equipment, such as a wetsuit and boots.

FIG. 2 shows the device in use with wet equipment 24, 26, with the zipper sliders 20*a*, 20*b* in partially unzipped position to reveal the equipment inside. The hanger member 34*a*, 34*b* allows the wet equipment to hang freely within the drying device as the equipment dries. The hanger member as shown here includes a hanger clip 34*a* at one end of a hanger bar (or cross-member) 34*b* that allows the hanger bar 34*b* to detach at that end and swing open for easy installation and removal of the wet equipment 24, 26. The waterproof funnel 10 is shown in its folded, water-holding position. Any suitable device or mechanism for hanging or securing the wet equipment inside the drying device can be used instead of or in addition to the hanger member shown here.

Figure 3:
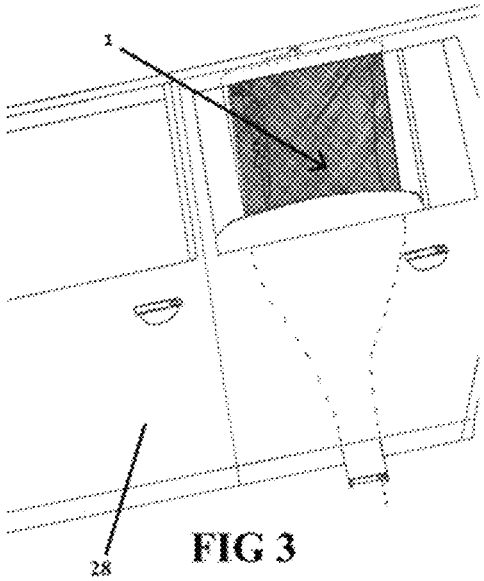
FIG. 3 shows the device hanging inside the rear passenger door of a car with the bottom end penetrating the closed door to allow water to flow out of the car.

FIG. 3 shows the drying device 1 in use inside a vehicle 28 with the waterproof funnel protruding through a vehicle door.

Figure 4:
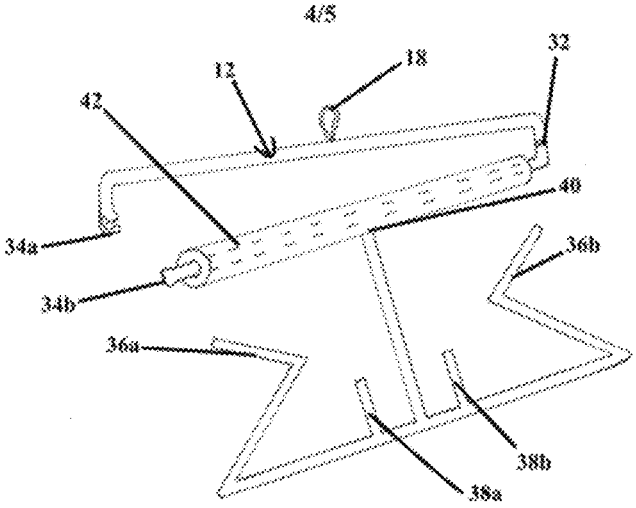
FIG. 4 shows hinged hanger system for the device.

FIG. 4 is a detailed view of one embodiment of the hanger system 12. A hinge 32 at one end and the hanger clip 34*a* at the other end together allow the hanger bar 34*b* to detach and swing open. Geometric equipment hangers 36*a*, 36*b* are designed to hold a wide variety of sporting equipment types (e.g., footwear or diving boots) in a position that aids removal of water and drying. Additional secondary equipment hangers 38*a*, 38*b* provide additional attachment points for equipment. The large-diameter hanger bar 42 forms the cross-member of the hanger system and is of sufficient diameter (width) to allow airflow and ventilation between the two halves of a garment, such as a wetsuit, that folds over it. In some embodiments the geometric equipment hangers 36*a*, 36*b* and the secondary equipment hangers 38*a*, 38*b* are removably attached to the large-diameter hanger bar 42 at an attachment point 40.

Figure 5:
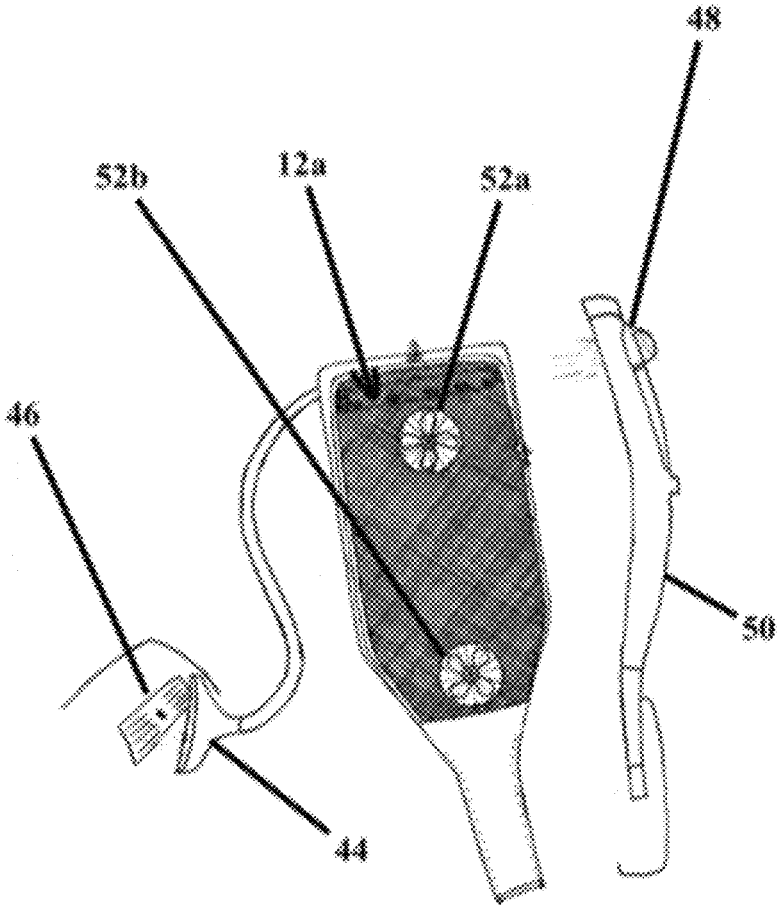
FIG. 5 shows devices with optional features to increase airflow over wet items.

FIG. 5 shows the drying device with additional airflow-maximizing functions. A duct connector 44 (or conduit) couples the drying device to a vehicle air-conditioning duct 46 (or other external air source) to harness airflow from the vehicle's fan and air-conditioning or heating system and direct it into the drying device. As shown here, the duct connector 44 connects to alternative hanger system having a hollow interior and perforations, or air ducts 12*a*, formed in its surface to produce additional air flow into the device and over the sports equipment to aid in moisture elimination. Ventilation fans 52*a*, 52*b* are also used in some embodiments to create greater air flow and aid in moisture elimination. The ventilation fans 52*a*, 52*b* can be placed in a wide variety of configurations to accomplish their purpose. In addition, as shown here in the side-profile view of a vehicle 50, a vehicle window air intake 48 can be installed in a vehicle's window to promote airflow from outside the vehicle into the device. The vehicle window air intake 48 can also be combined with the alternative hanger system having air ducts 12*a* to create forced air flow directly into the device and over the wet equipment.

The drying device is particularly useful in allowing for transport and storage of items (such as watersport equipment and apparel) in both wet and dry states. When transporting dry equipment that has been stored in the device, the user may choose to hang the device in the vehicle, lay it in the vehicle, or place it in a rolled or folded state into the vehicle. On arriving at a chosen recreation location, the user removes the equipment from the device by opening the zipper sliders 20*a*, 20*b* along the zipper chain 22 and removing the equipment from its stowed position on the various hanger system parts 42, 36*a*, 36*b*, 38*a*, 38*b*. If greater accessibility is required to remove the equipment, the hanger clip 34*a* may be used to release the hanger bar 34*b*. This allows the hanger bar 34*b* to swing open at the hinge 32 for easy installation and removal of the equipment, even while the device hangs within the vehicle. The attachment loop 18 can be fastened to stock hanger hooks or to a handle in the roof of the vehicle or to an added aftermarket attachment point installed in the vehicle.

Once the user returns to the car with wet gear, the user can open the car door and open the zipper sliders 20*a*, 20*b* along the zipper chain 22, if not already open. The user would then release the hanger bar 34*b* at the hanger clip 34*a* and swing it at the hinge 32 to gain access to the various hanger system parts 42, 36*a*, 36*b*, 38*a*, 38*b* and install the wet equipment. The user then reattaches the hanger bar 34*b* to the hanger clip 34*a*, closes the zipper sliders 20*a*, 20*b* along the zipper chain 22, and closes the car door with the bottom end of the waterproof funnel 10 exiting through the vehicle door, as shown in FIG. 3. The vehicle window can be rolled down to provide airflow into the device and over the equipment as the vehicle moves. The natural force of gravity coupled with the airflow through the device pulls water out of the wet equipment and along the waterproof back panel into the waterproof funnel 10, protecting the vehicle and items inside it from the water. The water exits the vehicle through gaps created by the rigid or semi-rigid structural elements 14*a*, 14*b* in the weather-stripping of the vehicle. If the car is driven with the windows up, the rigid or semi-rigid structural elements 14*a*, 14*b* create a vacuum effect that pulls air through the device and out of the vehicle as it travels. The device can be left in the position shown in FIG. 3 with the equipment stored neatly and shedding water. In some cases the equipment will be dry and ready for use later the same day or the next day even if left in the vehicle. The device can be removed from the vehicle and brought to a desired area (e.g., inside the user's house) for further rinsing and cleaning of the equipment, or, if the equipment and the device have been sufficiently cleaned and rinsed already, they can be moved directly to a desired location for further drying and/or final storage.

The device described here provides many advantages over traditional methods that have become commonplace for storing wet items. The device is designed especially for use within average-sized passenger vehicles, such as two-door and four-door sedans, but it is just as useful in motor homes, vans, trucks, boats, and planes, as well as when hiking on foot and using simply as a storage device.

The above description includes much specificity that should not be construed as limitations but rather as characteristics found in many possible embodiments. The described device can be constructed in a wide variety of materials, shapes, and arrangements that all still embrace the spirit of the invention and its functionality.

Additional embodiments may include but are not limited to a number of attachment arrangements, including hooks, Velcro, clips, buttons, snaps, or other connective methods. Additional embodiments may also include removable-attachment material interconnected to the top corners of the hanger system comprising snaps, buttons, straps, and Velcro. The ventilation tubes described above in the funnel portion can be replaced with several other types of structural materials and designs that provide the similar function of allowing water and air to flow out as the vehicle travels.

The simplest way to introduce airflow is to roll down a window while the device hangs in the vehicle. Certain embodiments may have a scoop that attaches into the window frame of a vehicle and injects air into the device as the car moves. Other embodiments may have a hose that connects to an air vent within the vehicle and injects air from the air conditioner or heater into the device. Still other embodiments may include one or more solar-powered or battery-powered fans that blow air into the device while the vehicle is parked. The hanger system can be constructed in many different arrangements to house a variety of equipment, and a variety of hanger systems can be swapped in and out of the device to adjust the device to the user's needs. Both the hanger and the overall assembly can be sized to suit the user. The device shape described here has proven functional but in no way limits other embodiments, which may take other shapes as required.

What is claimed is:

1. A drying apparatus for use in promoting drying of a wet item as it hangs within a passenger compartment of an automobile, the drying apparatus comprising:

a waterproof casing comprising one or more waterproof materials and constructed (a) to receive the wet item, (b) to prevent moisture in the wet item from contacting items in the the passenger compartment, and (c) to penetrate a weatherproof seal formed between a chassis and a closed door of the automobile as the wet item hangs within the passenger compartment, the waterproof casing having a drain structure at one end comprising:

an opening through which moisture from the wet item escapes the drying apparatus outside the automobile; and one or more rigid structures extending from within the waterproof casing through the opening, each constructed to hold shape and create a pathway for the escaping moisture while penetrating the weatherproof seal formed by the closed door as the wet item hangs within the passenger compartment; and an intake vent positioned to draw air into the drying apparatus and direct the air over the wet item within the drying apparatus and through the opening in the drain structure.

2. The drying apparatus of claim 1, further comprising a ventilated access panel that comprises the intake vent and is coupled to the waterproof casing in a manner to allow placement of the wet item within the waterproof casing.

3. The drying apparatus of claim 2, further comprising a zipper device coupling the ventilated access panel to the waterproof casing to allow access within the waterproof casing.

4. The drying apparatus of claim 1, further comprising an internal hanger coupled to the waterproof casing to support the wet item as it dries within the drying apparatus.

5. The drying apparatus of claim 4, further comprising an external hanger coupled to the internal hanger to allow (a) hanging of the drying apparatus from an external structure and (b) transfer of weight from the internal hanger to the external structure.

6. The drying apparatus of claim 1, further comprising one or more attachment mechanisms operable to allow temporary closure of the drain structure to prevent water from escaping the drying apparatus.

7. The drying apparatus of claim 1, further comprising a conduit coupled to the water-proof casing to direct air from an external air source directly into the drying apparatus.

8. The drying apparatus of claim 1, further comprising multiple hanger coupled to the waterproof casing and operable to receive and support multiple wet items within the drying apparatus.

* * * * *